United States Patent [19]

Galloway, deceased et al.

[11] 4,345,695

[45] Aug. 24, 1982

[54] LID FOR A DRINKING CUP

[76] Inventors: James V. Galloway, deceased, late of Winnetka, Ill., by Dean K. Galloway; Scott F. Galloway, 2037 Pratt Ct., Evanston, Ill. 60093

[21] Appl. No.: 145,700

[22] Filed: May 1, 1980

[51] Int. Cl.[3] ..... A47G 19/22; B65D 41/26; B65D 51/16

[52] U.S. Cl. ..... 220/254; 220/904; 220/367; 229/7 R; 229/43

[58] Field of Search ..... 220/90.2, 90.4, 254, 220/268, 367; 229/7 R, 43; 215/309, 311, 315

[56] References Cited

U.S. PATENT DOCUMENTS

| | | | |
|---|---|---|---|
| 2,003,657 | 6/1935 | Stabblefield | 215/317 X |
| 2,646,670 | 7/1953 | Spalding et al. | 215/311 |
| 3,421,681 | 1/1969 | Frank | 229/43 |
| 3,635,380 | 1/1972 | Fitzgerald | 220/90.4 X |
| 3,727,808 | 4/1973 | Fitzgerald | 220/90.4 X |
| 3,927,794 | 12/1975 | Erdman | 220/90.4X |
| 3,982,658 | 9/1976 | Bozek et al. | 220/268 X |
| 4,081,103 | 3/1978 | Zofllick | 220/90.4 X |
| 4,113,135 | 9/1978 | Yamazaki | 220/90.4 X |
| 4,121,731 | 10/1978 | Okerstrum | 220/90.4 |
| 4,138,033 | 2/1979 | Payne et al. | 220/254 |
| 4,184,604 | 1/1980 | Ambers et al. | 220/90.4 X |
| 4,186,842 | 2/1980 | Albert | 220/90.4 X |

*Primary Examiner*—Allan N. Shoap

*Attorney, Agent, or Firm*—Neuman, Williams, Anderson & Olson

[57] ABSTRACT

A lid is provided for removably mounting on the rim of a drinking cup. The lid includes a center section which overlies an area defined by the cup rim, and a peripheral section which delimits the center section and snugly fits over the cup rim. The center section is provided with a drinking portion through which a predetermined amount of the cup contents will flow. Associated with the drinking portion is a flow control means which is biased to normally assume a flow-stopping position. The control means assumes an open flow position upon a predetermined manual pressing force being applied thereto during drinking from the cup.

1 Claim, 7 Drawing Figures

FIG. 1
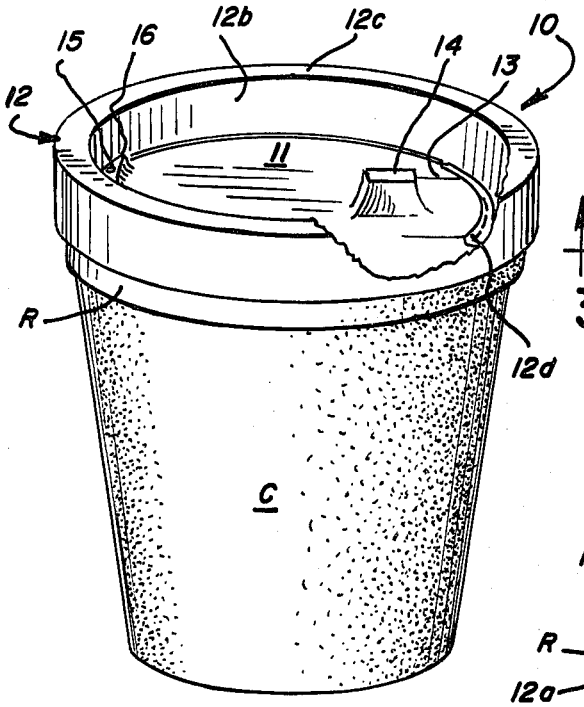
FIG. 2
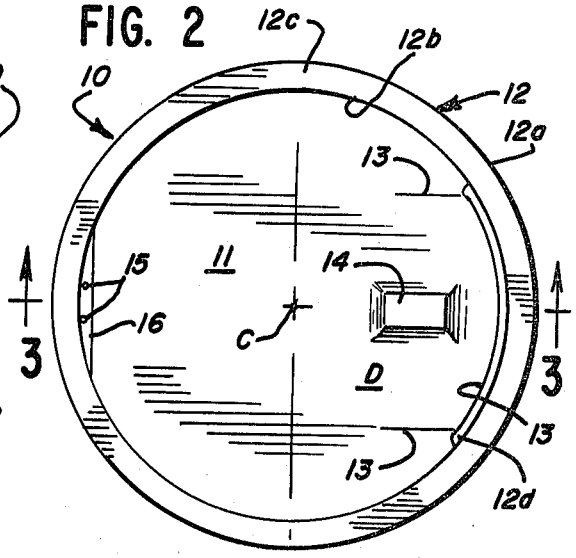
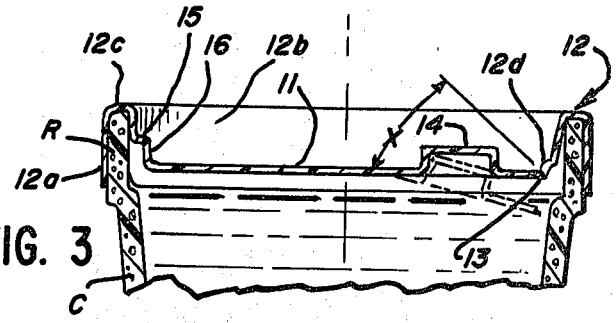
FIG. 3
FIG. 4
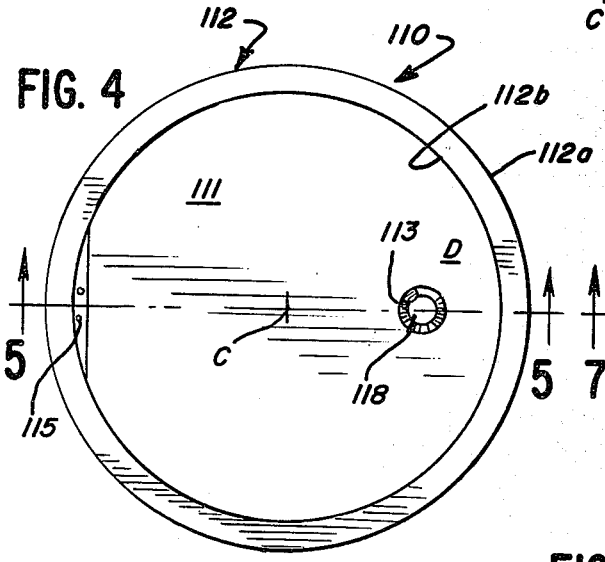
FIG. 6
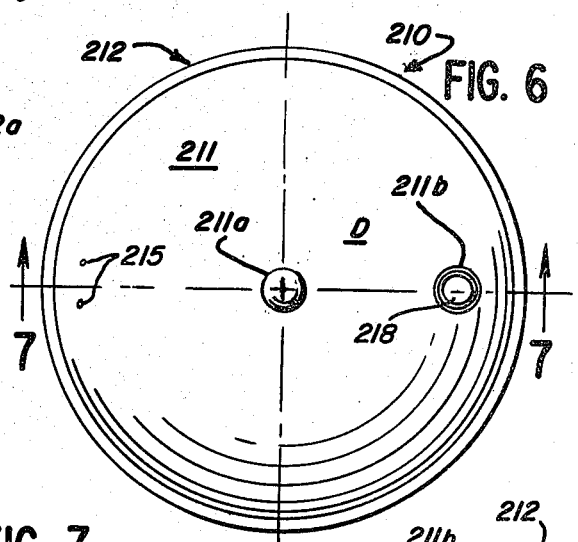
FIG. 5
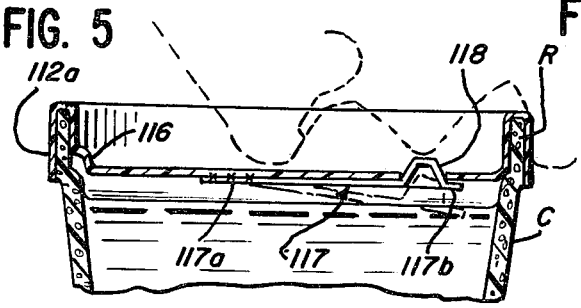
FIG. 7
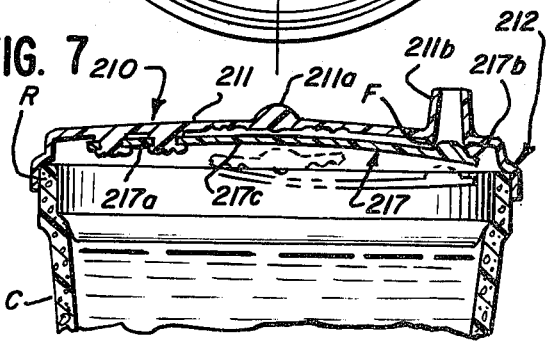

LID FOR A DRINKING CUP

BACKGROUND OF THE INVENTION

Various removable lids for drinking cups have heretofore been provided, however, because of certain design characteristics they are beset with one or more of the following shortcomings: (a) the lid is of a costly and complex construction; (b) the lid is difficult and awkward to assemble on or remove from the rim of a drinking cup; (c) the lid is highly susceptible to leakage; (d) the lid causes discomfort and frustration to the person drinking from the cup with the lid in place; (e) the lid is not capable of being used with drinking cups of various designs and (f) the lid, when in place on the cup, requires a straw or the like to be used therewith when a person is drinking from the cup.

SUMMARY OF THE INVENTION

Thus, it is an object of the invention to provide a lid which avoids all of the aforenoted shortcomings associated with prior art structures.

It is a further object to provide a lid which will protect the contents of the cup from dirt and other foreign matter when a filled cup is resting upon a supporting surface.

It is a further object to provide a lid of simple and inexpensive design which does not require straws or the like to be used therewith.

It is a still further object to provide a lid which is of compact, light-weight design and may be readily shipped or stored in bulk.

Further and additional objects will appear from the description, accompanying drawing, and appended claims.

In accordance with one embodiment of the invention, a lid is provided for removably mounting on the rim of a drinking cup. The lid includes a center section which conforms substantially to the area defined by the cup rim. A peripheral section delimits the center section and snugly fits over the cup rim. The center section is provided with a drinking portion through which a predetermined amount of the cup contents is adapted to flow. Associated with the drinking portion is a flow control means which is biased to normally assume a flow-stopping position. The control means assumes an open flow position upon a predetermined manual pressing force being applied thereto during drinking from the cup.

DESCRIPTION

For a more complete understanding of the invention reference should be made to the drawings wherein:

FIG. 1 is a perspective top view of one form of the improved lid shown mounted on the rim of a conventional drinking cup.

FIG. 2 is a top plan view of the lid of FIG. 1.

FIG. 3 is a sectional view taken along lines 3—3 of FIG. 2; the flow control means shown in phantom lines in an open flow position.

FIG. 4 is similar to FIG. 2, but showing a second form of the improved lid.

FIG. 5 is a sectional view taken along line 5—5 of FIG. 4 and showing in phantom lines the flow control means being depressed by the upper lip of the person drinking from the cup.

FIG. 6 is similar to FIGS. 2 and 4, but showing a third form of the improved lid.

FIG. 7 is a sectional view taken along lines 7—7 of FIG. 6 and showing in phantom lines a fragmentary portion of the flow control means in an open flow position.

Referring now to the drawing and more particularly to FIGS. 1–3, one form of the improved lid 10 is shown removably mounted on the annular rim R of a conventional drinking cup C of the nesting type. The cup may be formed of paper, plastics, glass, or the like and forms no part of the invention hereinafter described.

The lid 10 may be vacuum-formed from a thin (e.g., 0.015") sheet of plastic material (e.g., styrene) which is inert to contents of the cup. The lid 10 includes a center section 11 which has a shape conforming substantially to the area defined by the cup rim R. The center section 11 is delimited by a peripheral section 12 which snugly fits over the cup rim R, as seen more clearly in FIG. 3. The peripheral section 12 includes an annular outer wall segment **12*a* which depends a substantial distance from the cup rim and encompasses a wide bandlike exterior surface portion of the cup rim R; an annular inner wall segment 12*b* which engages the interior surface of the rim; and a bight segment 12*c* which interconnects the upper edges of segments 12*a*, 12*b*. The spacing between segments 12*a*, 12*b* is such that the peripheral section 12 will frictionally grip the cup rim, thereby preventing accidental removal of the lid from the rim. By reason of the outer wall segment 12*a*** overlying a wide bandlike portion of the exterior surface of the cup, the lower lip of a person drinking from the cup forms an effective seal therewith and prevents accidental dripping of the contents.

As noted in FIGS. 1 and 3, the center section 11 is recessed relative to the top of the peripheral section 12, thereby preventing dripping of any excess liquid which might accumulate on the exposed surface of the center section during and subsequent to drinking from the cup. The center section 11 includes a drinking portion D which is offset from the center of section 11. Portion D is provided with an elongated non-rectilinear (e.g., crescent-shape, V-shape, U-shape, etc.) slit 13 disposed adjacent a portion **12*d* of inner wall segment 12*b*; the latter being in the form of a stiffening rib. The slit 13** is formed by a cut made at an angle X not exceeding approximately 45° relative to the exposed surface of portion D, as seen in FIG. 3. By reason of the angular disposition of the cut, the upper portion of the slit adjacent the rib overlies the other or lower portion, thereby resulting in a more effective seal when the slit is closed, as will be described more fully hereinafter.

The drinking portion D also includes a protuberance 14 which is located between the slit 13 and the center C of center section 11 and projects upwardly from the latter. The protuberance is hollow and preferably has a height less than that of the peripheral section 12. The configuration and location of the protuberance 14 are such that the upper lip of the person drinking from the cup will normally engage same and exert a pushing force thereon, causing a substantial part of the drinking portion D, including the lower portion of the slit 13, to flex downwardly from the upper overlying portion of the slit, as seen in phantom lines in FIG. 3, thereby permitting outward flow of the cup contents when the cup is tilted for drinking. Thus, the protuberance 14 and slit 13 coact to form a means for controlling the flow of liquid through the slit. The inherent resiliency of the sheet material, of which the lid 10 is formed, biases the slit portions to normally assume a stop-flow, or close, position; as shown in full lines in FIG. 3. The shape of the protuberance 14 is such that it will not cause discomfort when engaged by the upper lip of the person drinking from the cup.

Disposed substantially diametrically opposite the protuberance 14 are one or more small breather holes 15 formed in a small plateau 16. The plateau is formed in the center section and adjacent the peripheral section 12. The holes avoid the possibility of a vacuum-like condition occurring within the cup while the contents thereof are flowing out through an open slit 13. By reason of the elevation of the plateau, the holes 15 are not susceptible to being clogged by any excess liquid which might accumulate on the exposed surface of the center section. The holes are of such size that little or no spillage or leakage of the contents will occur therethrough if the cup with the lid in place is subjected to vigorous shaking, or is knocked over, as might occur while being supported in a moving automobile, truck, airplane, etc. Furthermore, the protuberance 14 is hollow and open to the interior of the cup, so that if the cup was accidentally knocked over or turned upside-down, the contents of the cup will exert hydraulic pressure on the protuberance and surrounding portions of the center section 11, urging the slit 13 to remain closed.

The length and shape of slit 13 and the shape of protuberance 14 may vary from that shown and will depend in part upon the thickness and inherent resiliency of the sheet material from which the lid 10 is made.

A second form 110 of improved lid is shown in FIGS. 4 and 5. In order to facilitate understanding of the construction of lid 110, portions thereof corresponding to those of lid 10 will be given the same identifying numeral, but in a 100 series. The principal distinctions between lid 10 and lid 110 are that in the latter, an enlarged opening 113 is substituted for slit 13 and a separate closure flap 117 is substituted for the combination of the slit 13 and protuberance 14.

The opening 113 is offset a substantial distance from the center C of the center section 11 and is formed in the drinking portion D of the latter. Flow of the cup contents out through the opening 113 is controlled by the flap 117 which has one end 117*a* thereof affixed by adhesive or the like to the underside, or concealed surface, of the center section 111, see FIG. 5. The distance the attachment of the flap end 117*a* is from the opening 113 will depend upon the inherent resiliency of the flap material.

The opposite flap end 117*b* is of such configuration that it will close-off the opening 113 when the flap 117 assumes its normal position. Due to the inherent resiliency of the flap 117, the latter will normally assume the closing position shown in full lines in FIG. 5. Formed in flap end 117*b* is a hollow, tapered protuberance 118 which is sized so as to readily project a substantial distance through the opening 113, when the flap is in normal close position. The exposed upper end of protuberance 118 is adapted to be engaged and depressed into the opening 113 by the upper lip of the person drinking from the cup. A partial facial profile of such a person is shown in phantom lines in FIG. 5. It is to be understood, of course, when drinking from the cup that the latter is manually tilted rather than remaining upright as shown. At the same time the upper lip is engaging and depressing the protuberance 118, the person's lower lip is overlying the depending outer wall segment 112*a* of the peripheral section 112 and forms a seal therewith.

FIGS. 6 and 7 illustrate a third embodiment 210 of the improved lid. The center section 211 of lid 210 normally assumes a slightly crown or concavo-convex condition, as seen more clearly in FIG. 7. In the illustrated embodiment, the center section 211 is not recessed relative to the peripheral section 212. If desired, however, such recessing like in lids 10, 110 may be incorporated in lid 210. Peripheral section 212 in the illustrated lid 210 merely encompasses the exterior of the cup rim rather than both the exterior and interior surfaces, as in the case of lids 10, 110. Centrally disposed of center section 211 is a nub 211*a* which locates the point where manual finger pressure is to be applied while a person is drinking from the cup.

The center section 211 has a drinking portion D which is provided with an upwardly extending spout 211*b* through which the contents of the cup is caused to flow. The lower or concealed open end of the spout is delimited by a depending narrow flange F. An elongated flap 217 is mounted on the underside, or concealed surface, of the center section 211, and because of its inherent resiliency, is biased to normally close-off the spout lower open end. One end 217*a* of the flap is affixed to the underside of the center section 211 at a location which is substantially diametrically opposite the spout 211*b* and is spaced a substantial distance from nub 211*a*. The opposite distal end 217*b* of the flap normally subtends the spout lower open end and is provided with a protuberance 218 which is adapted to seat against the flange F and effectively provide a closing seal for the spout opening.

When it is desired to move the flap 217 to a spout-open position, finger pressure is exerted on nub 211*a* or in the vicinity thereof causing a substantial part of the center section to be distorted inwardly, as seen in phantom lines in FIG. 7. The distorted part of the center section 211, engages a central segment 217*c* of the flap, and causes the distal end 217*b* of the flap and the associated protuberance 218 to move downwardly away from the spout opening thereby permitting flow of the cup contents through the spout when the cup is tilted. The height, shape, and size of the spout may vary as desired.

Lid 210 may be formed by injection molding from a variety of suitable plastics (e.g., polyethylene; polypropylene).

Thus, it will be seen that an improved lid has been provided which is of simple and inexpensive construction, can be readily used with a variety of cup styles, is inert to the cup contents, is easy to assembly on or remove from the rim of a cup, does not cause discomfort to the user, and substantially prevents loss of the cup contents when the cup is overturned or is subjected to vigorous shaking.

We claim:

1. A lid for removable mounting on the rim of a drinking cup, the lid comprising:

(a) a substantially planar center section adapted to conform substantially to an area defined by the interior of the rim of the cup;

(b) a peripheral section delimiting said center section and adapted to fit snugly over said rim of the cup, the peripheral section consisting of an annular inner wall segment rising substantially vertically from the edge of the center section, an annular outer wall segment depending a substantial distance from the exterior of said rim of the cup to form a seal with the lower lip of a person drinking from the cup, and a bight segment connecting the upper edges of the inner and outer wall segments;

(c) a stiffening rib formed along a portion of the peripheral section adjacent the confluence of the bottom edge of said inner wall segment of said peripheral section with said substantially planar center section;

(d) an elongated U-shaped slit in said center section describing a resilient drinking portion in the center section, the bight portion connecting the two legs of said U-shaped slit being juxtaposed said stiffening rib and beveled at an angle not to exceed about 45° relative to the exposed surface of said center section;

(e) elevated breathing means formed in said center section diametrically opposite said elongated U-shaped slit, said breathing means preventing the occurrence of a vacuum-like condition within the cup during drinking from the cup; and (f) a protuberance formed in said center section substantially equidistant from the ends of said U-shaped slit and spaced away from the bottom of said U-shaped slit, the protuberance projecting upward a substantial distance from said center section but not exceeding the height of said inner wall segment of the peripheral section, the protuberance having a hollow interior adapted to communicate with the interior of the cup when the lid is mounted on the rim of the cup and sized relative to the drinking portion so that the latter is substantially open upon a predetermined depressing force being applied to the protuberance by the upper lip of a person drinking from the cup.

* * * * *